US005553353A

United States Patent [19]

Lin

[11] Patent Number: 5,553,353

[45] Date of Patent: Sep. 10, 1996

[54] DOOR DAMPING SYSTEM

[76] Inventor: Wu-shoun Lin, 1st Fl., No. 46, Lane 178, Sungchu Rd., Taichung, Taiwan

[21] Appl. No.: 543,131

[22] Filed: Oct. 13, 1995

[51] Int. Cl.[6] ..... E05F 5/02

[52] U.S. Cl. ..... 16/82; 16/59; 16/79; 16/62

[58] Field of Search ..... 16/82, 51, 49, 16/52, 58, 59, 79, 62, 64, 50, 378

[56] References Cited

U.S. PATENT DOCUMENTS

| | | | |
|---|---|---|---|
| 4,019,220 | 4/1977 | Lieberman | 16/59 |
| 4,115,897 | 9/1978 | Zunkel | 16/79 |
| 5,187,835 | 2/1993 | Lee | 16/58 |
| 5,259,090 | 11/1993 | Fayngersh | 16/51 |

FOREIGN PATENT DOCUMENTS

| | | | |
|---|---|---|---|
| 2116251 | 9/1983 | United Kingdom | 16/79 |

*Primary Examiner*—Chuck Y. Mah
*Attorney, Agent, or Firm*—William E. Pelton

[57] ABSTRACT

A door damping system includes a base fixed to a wall, a fixing element fixed to the door and a rod connected between the base and the fixing element, the base having a pinion rotatably disposed in the base and the pinion coupled to the rod and a coil spring, a cylinder having a slidable piston rod which has a first end with a rack which is slidably received in the base for an engagement with the pinion and a second end with a piston slidably disposed in the cylinder in which oil is filled, the piston having a first and a second flanges, the first flange having a gap defined between the first flange and an inner periphery of the cylinder, the second flange having a plurality of fifth holes defined therein and a first clearance being defined between the piston and the piston rod, a ring movably disposed between the first and the second flanges so as to seal the gap when the door is returned and oil can only flow through the first clearance so as to slow down the speed of returning of the door.

3 Claims, 6 Drawing Sheets

DOOR DAMPING SYSTEM

BACKGROUND OF THE INVENTION

1. Field of Invention

The present invention relates to a door damping system and more particularly to a door damping system which provides a damping feature when closing the door.

2. Related Prior Art

A door damping system is designed to prevent the door from slamming back as a result of wind or by mischievous action of a user to hurt the following person. Such damping is obviously an important feature for a door used in the public places such as in a department store or a school. Additionally, users want to have a door damping system which provides a feature of positioning the door at required angle when closing or opening the door.

The present invention intends to provide an improved door damping system to mitigate and/or obviate the above-mentioned problems.

SUMMARY OF THE INVENTION

The present invention provides a door damping system which includes a base fixed to a wall, a fixing element fixed to the door and a rod connected between the base and the firing element, the base having a pinion rotatably disposed in the base and the pinion coupled to the rod and a coil spring, a cylinder having a slidable piston rod which has a first end with a rack which is slidably received in the base for an engagement with the threaded portion of the rotating element and a second end with a piston slidably disposed in the cylinder with the piston rod, the cylinder having oil filled therein, the piston having a first and a second flanges, the first flange having a gap defined between the first flange and an inner periphery of the cylinder, the second flange having a plurality of fifth holes defined therein and a first clearance being defined between the piston and the piston rod, a ring movably disposed between the first and the second flanges so as to seal the gap when the door is returned and oil can only flow through the first clearance so as to slow down the speed of returning of the door.

It is an object of the present invention to provide a door damping system which slows down the speed of returning of the door and provides a smooth and steady door-opening action.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
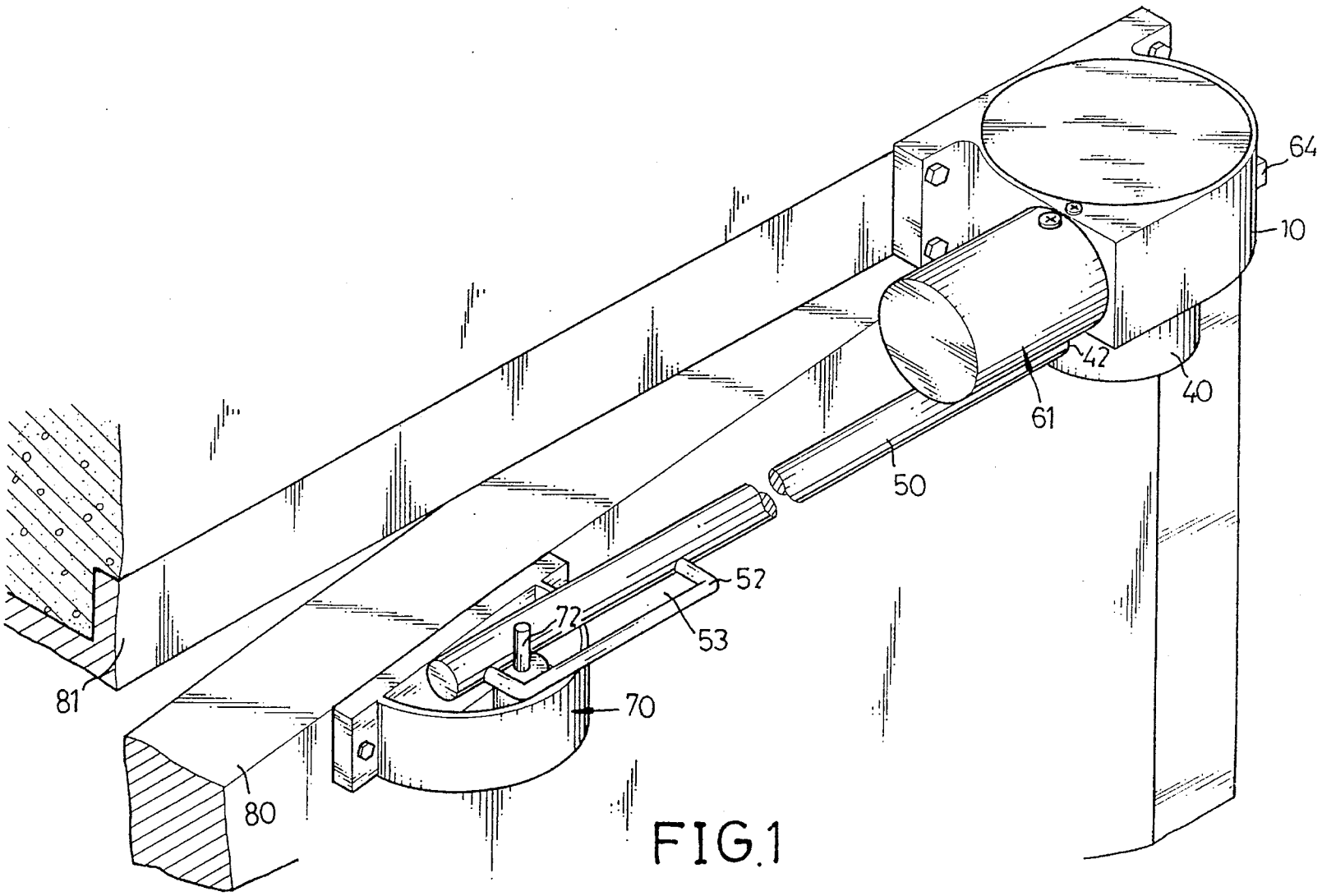
FIG. 1 is a perspective view of a door damping system in accordance with the present invention.
Figure 2:
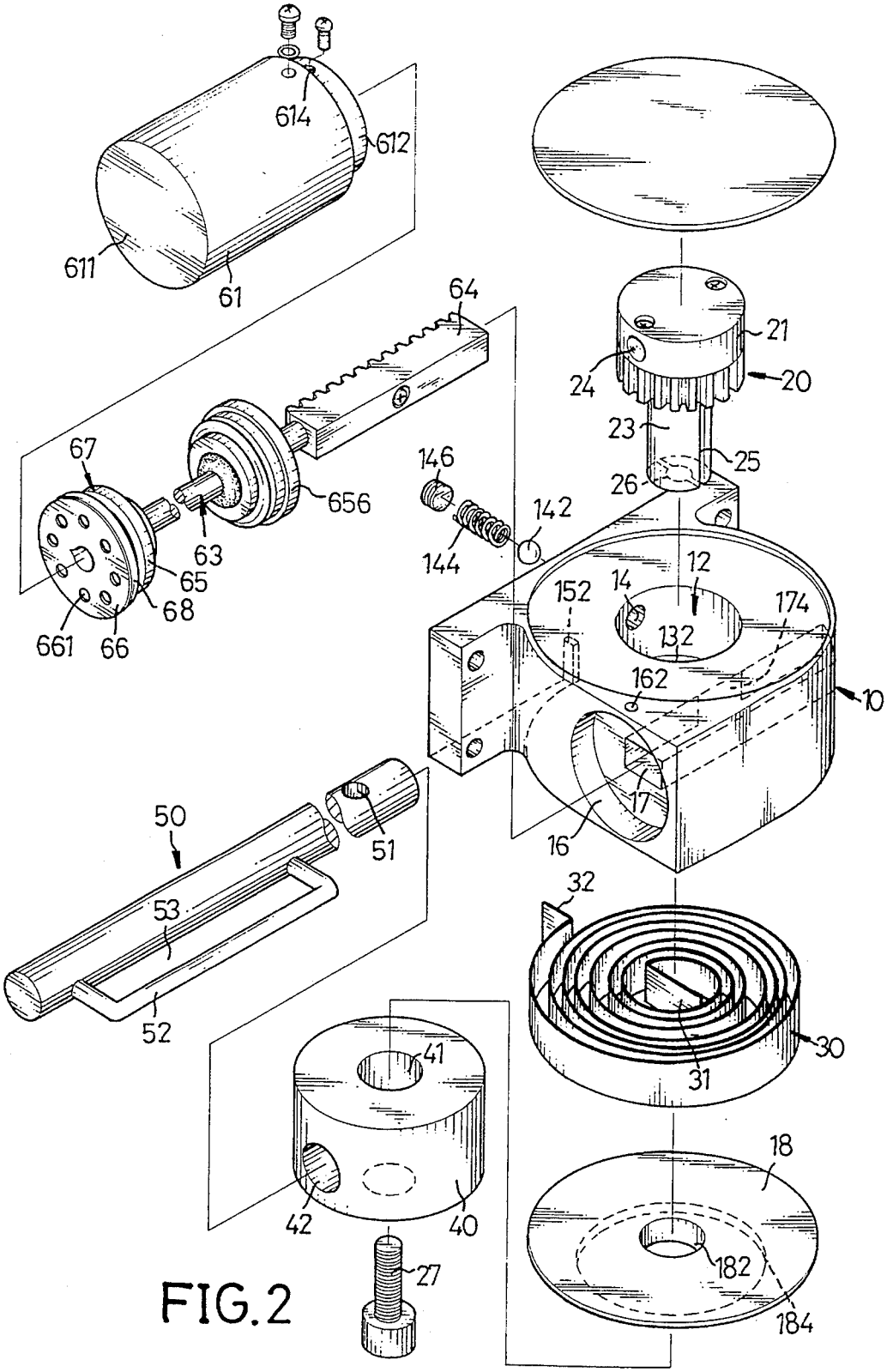
FIG. 2 is an exploded view of the door damping system in accordance with the present invention.
Figure 3:
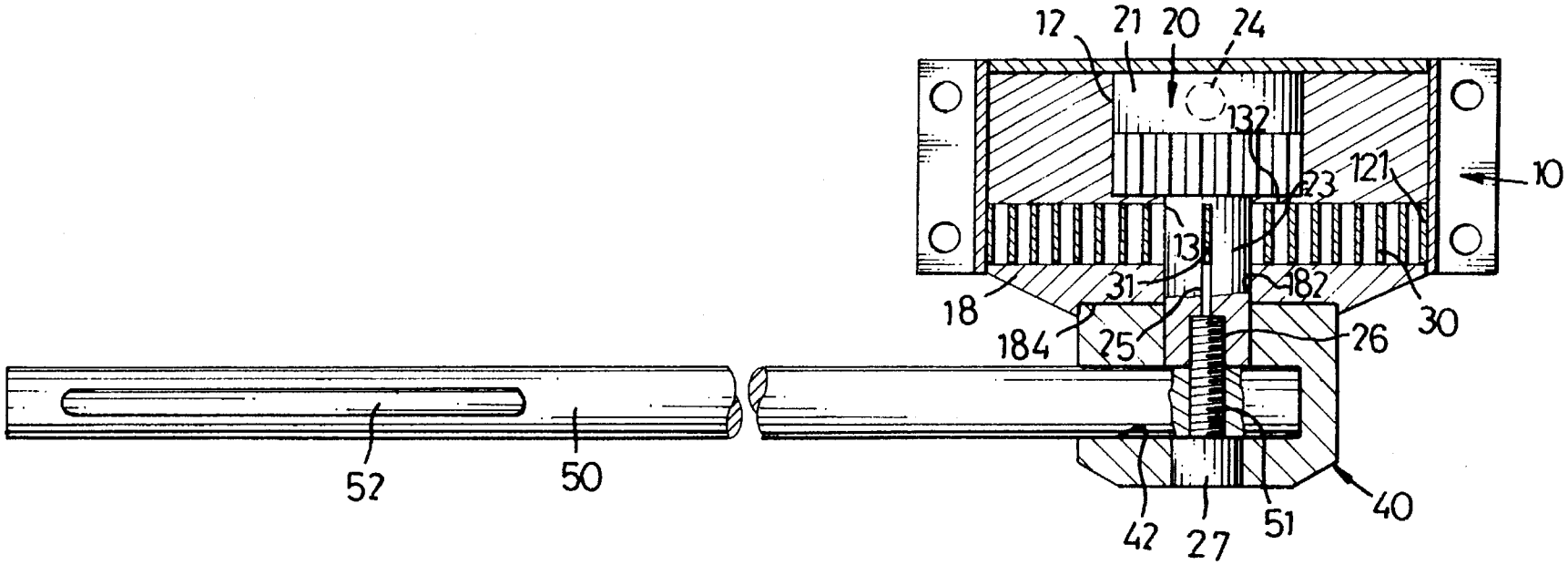
FIG. 3 is a side elevational view, partly in section, of an engagement between a base and a rod in accordance with the present invention.
Figure 4:
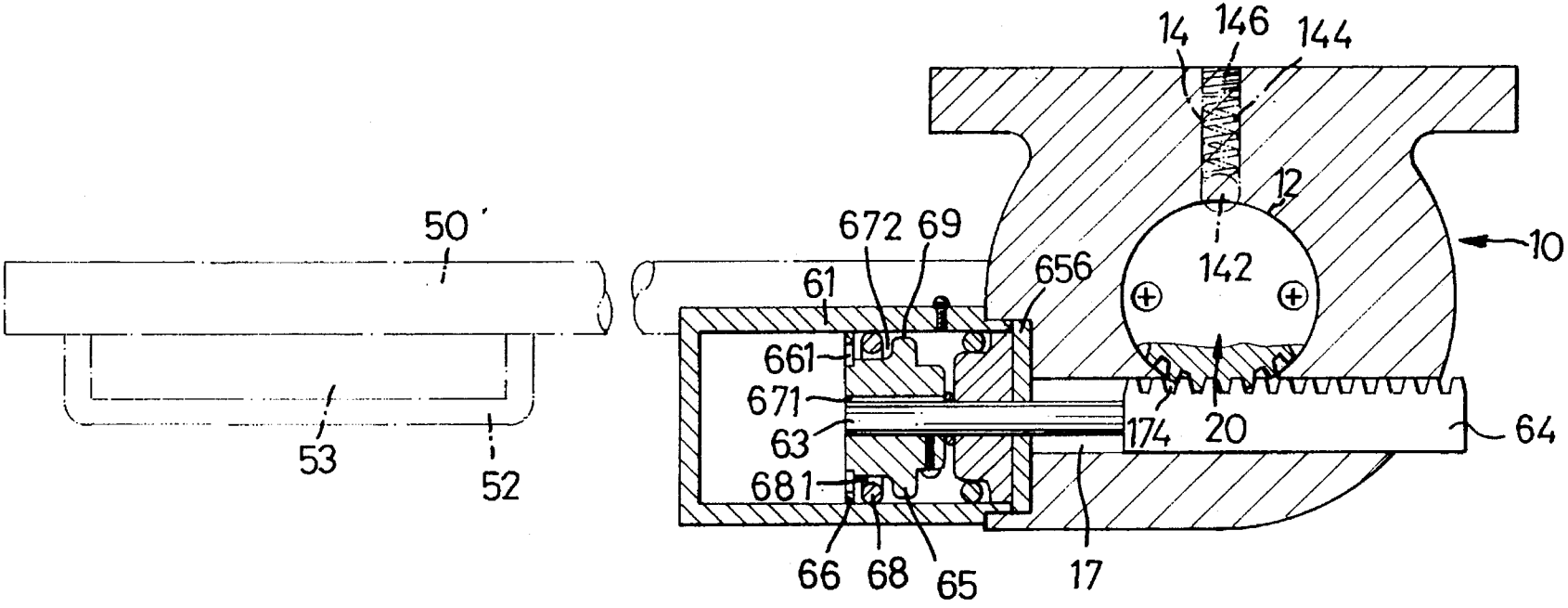
FIG. 4 is a top plane view, partly in section, of an engagement between a cylinder, the rod and the base.

Referring to the drawings and initially to FIGS. 1 through 4, a door damping system in accordance with the present invention generally includes a base 10, a fixing element 70, a rod 50 connecting between the base 10 and the fixing element 70 which is fixed to an upper portion of the door 80 and a cylinder 61. The base 10 is fixed to a wall 81 corresponding to a pivotal side of the door 80 and has a first recess 12 defined in an upper side thereof, the first recess 12 being defined by a bottom 132 which has a first hole 13 centrally defined therein, a second recess 121 defined in a bottom side of the base 10 and the second recess 121 coaxially communicating with the first hole 13. A side slot 17 is defined in the base 10 near an outer side of the base 10 and opposite to the wall 81 and extending perpendicular to an axis of the first recess 12. The side slot 17 extends from a front surface of the base 10, through the base 10 and to a rear surface of the base 10 wherein the side slot 17 communicates with the first recess 12 via a middle hole 174 defined in the base 10 and located between the side slot 17 and the first recess 12. The base 10 has a fifth recess 16 laterally defined in the front surface thereof and which communicates with the side slot 17, a first slit 152 defined in the bottom side of the base 10 and communicating with the second recess 121 and opposite to the outer side of the base 10.

A pinion 20 has a T-shaped configuration and including a head 21 and a shank 23, the head 21 having a second slit 25 defined longitudinally therein and extending from a bottom of the shank 23, a threaded recess 26 defined in the shank 23 and extending from the bottom of the shank 23. The head 21 is received in the first recess 12 and the shank 23 extends downwardly through the first hole 13 of the base 10. A coil spring 30 is received in the second recess 121 of the base 10 and has a first end 31 formed in a center of the coil and a second end, the first end 31 is received in the second slit 25 of the shank 23 and the second end received in the first slit 152 of the base 10.

A lower cap 18 is mounted to the bottom side of the base 10 and supports the coil spring 30, the lower cap 18 having a second hole 182 defined centrally therein and having a third recess 184 defined in a bottom thereof for receiving a connecting block 40 therein which has a through hole 41 defined longitudinally therein and a side hole 42 defined radially from a periphery thereof, the side hole 42 communicating with the through hole 41.

The rod 50 has a first end and a second end, the first end thereof having a fourth hole 51 defined radially therethrough, the first end of the rod 50 being inserted into the side hole 42 of the connecting block 40 and a bolt 27 being extending through the through hole 41, the fourth hole 51 and being engaged with the threaded recess 26 of the shank 23 of the rotating element 20, the second end of the rod 50 having a frame 52 formed thereto so as to define an elongated space 53 between the rod 50 and the frame 52 for receiving a stud 72 extending from the fixing element 70 therein.

The cylinder 61 is filled with oil and has a neck portion 612 extending longitudinally therefrom so as to be inserted into the fifth recess 16 of the base 10 and is positioned by threading a bolt (not numbered) through a hole 162 defined in the upper surface of the base 10 and being engaged with a threaded hole 614 defined in the neck portion 612 such that the cylinder 61 is securely disposed to the front surface of the base 10. The cylinder 61 has a first end and a second end, the first end thereof having an end plug 656 to close the first end and the second end thereof having a bottom 611. The end plug 656 has a central hole defined therethrough for a piston rod 63 being slidably received therein which has a first end and a second end, the first end thereof having a rack 64 which is inserted in the side slot 17 of the base 10 for an engagement with the pinion 20. The second end of the piston rod 63 has a piston 67 disposed thereto, the piston 67 having a first clearance 671 defined between the piston rod 63 and the piston 67 and having a first flange 65 and a second flange 66 respectively extending radially from an outer periphery thereof and defining a first groove 672 between the first and the second flanges 65, 66.

Figure 5:
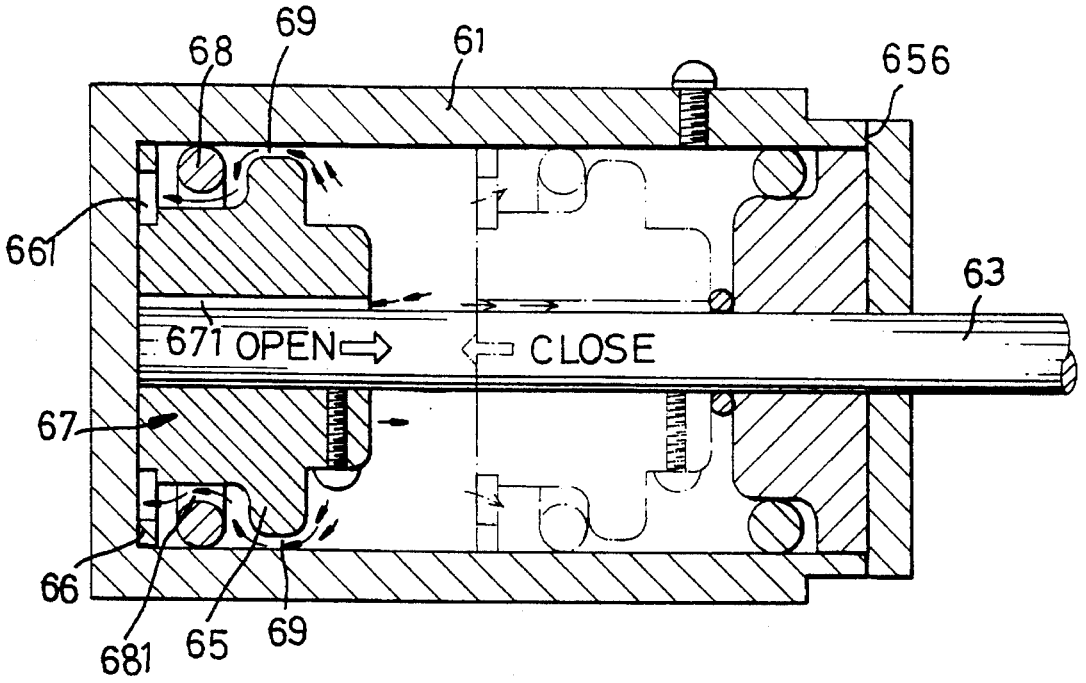
FIG. 5 is a side elevational view, partly in section, of the cylinder.

Referring further to FIG. 5, the first flange 65 has an outer diameter smaller than an inner diameter of the cylinder 61 such that a gap 69 is defined between the first flange 65 and the cylinder 61. A ring 68 is movably disposed between the first flange 65 and the second flange 66, a second clearance 681 is defined between an inner periphery of the ring 68 and the piston rod 63. The second flange 66 has a plurality of sixth holes 661 defined therein. The ring 68 is moved to contact against the first flange 65 and the second flange 66 depending upon a movement of the piston rod 63, when the piston 67 is moved toward the first end of the cylinder 61 to open the door 80, the ring 68 being moved to contact the second flange 66 and the sixth holes 661 being partially covered by the ring 68, therefore, oil transferred through the first clearance 671, the gap 69, second clearance 681 and the sixth holes 661 gap 69 to push the piston 67 toward the first end of the cylinder 61 such that the speed to open the door 80 is steady and smooth. When closing the door 80, rod 63 is moved toward the bottom 611 of the cylinder 61 and the rotating element 20 is rotated because of the engagement between the threaded portion 22 and the threaded rod 64, the piston 67 is therefore moved toward the bottom 611 of the cylinder 61, the ring 68 is pushed by the oil to be moved to contact the first flange 65 and to seal the gap 69 such that the oil can only flow via the first clearance 671 and this slows the speed of the closing door 80.

To have a positioning feature of the door 80 during the opening or the closing processes, the base 10 has a fifth hole 14 defined laterally therein which is located opposite to the side slot 17 and communicates with the first recess 12, the fifth hole 14 has a threaded section (not shown) defined in an inner portion thereof so as to receive a ball 142 and a spring 144 in the fifth hole 14 and a small bolt 146 threadedly engaged with the threaded section to adjust the spring 144. The head 21 of the rotating element 20 has at least one fourth recess 24 defined in an outer periphery thereof so as to receive the ball 142 therein when the head 21 of the pinion 20 is rotated to a certain position, that is to say, the door 80 can be positioned at a certain angle corresponding to the wall 81.

Figure 6:
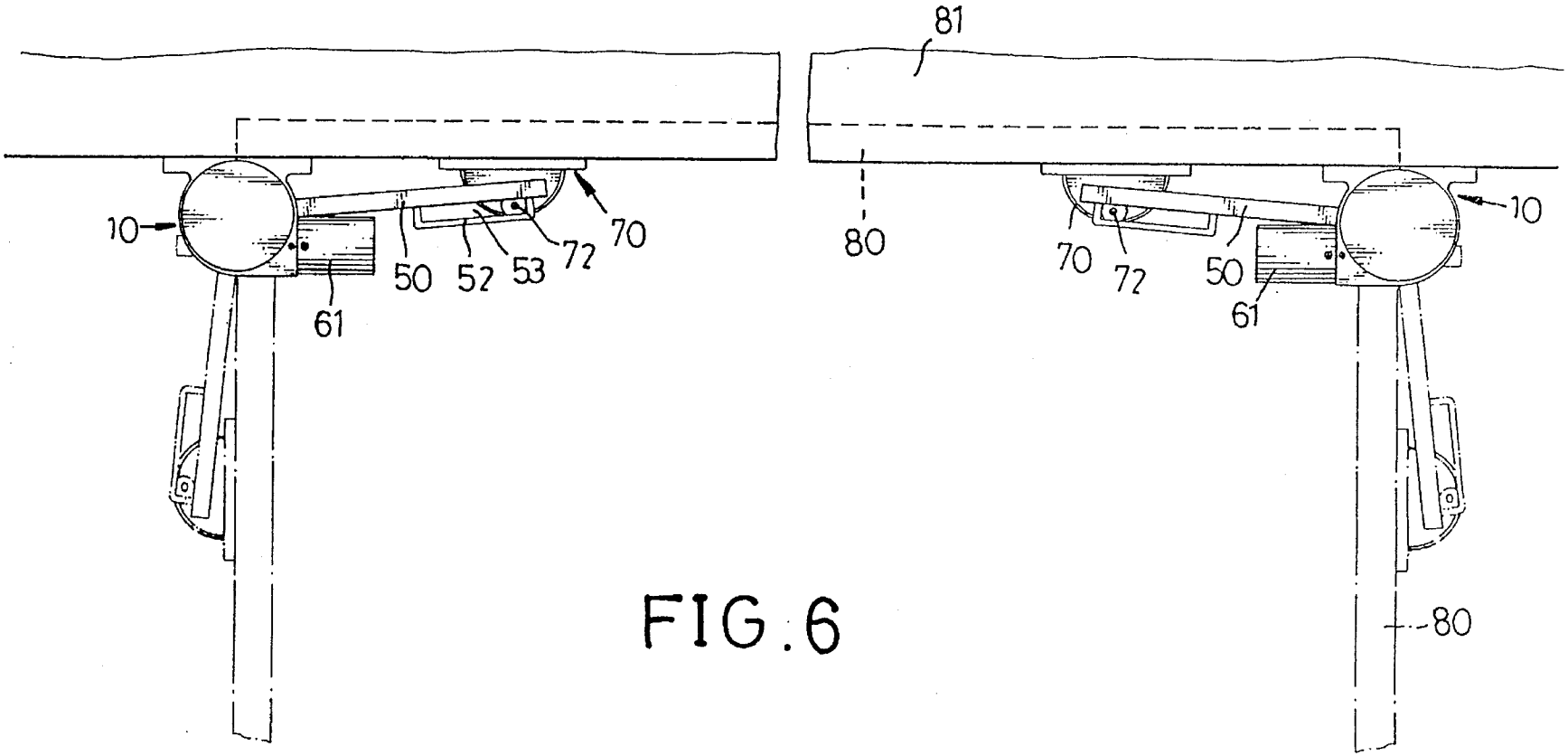
FIG. 6 is an illustrative view and shows the door damping system used on a right-handed opening door and a left-handed opening door.

Referring now to FIG. 6, the cylinder 61 can be moved to be disposed to the rear surface so as to be adapted to a left-handed opening door. Accordingly, the door damping system in accordance with the present invention provides a feature which slows down the speed of the closing door and the door can be positioned when it is opened or closed at a certain angle corresponding to the wall 81.

Although the invention has been explained in relation to its preferred embodiment, it is to be understood that many other possible modifications and variations can be made without departing from the spirit and scope of the invention as hereinafter claimed.

I claim:

1. A door damping system comprising a base, a fixing element, a rod connecting between said base and said fixing element which is fixed to a door and a cylinder, said base being fixed to a wall and having a first recess defined in an upper side thereof and said first recess being defined by a bottom which has a first hole defined therein, a second recess defined in a bottom side of said base and said second recess coaxially communicating with said first hole, a side slot defined in said base near an outer side of said base and opposite to said wall and extending perpendicular to an axis of said first recess, said side slot extending from a front surface of said base through said base and to a rear surface of said base wherein said side slot communicating with said first recess via a middle hole defined in said base and located between said first recess and said side slot, a first slit defined in said bottom side of said base and communicating with said second recess and opposite to said outer side of said base;

a pinion having a T-shaped configuration and including a head and a shank, said shank having a second slit defined longitudinally therein and extending from a bottom of said shank, a threaded recess defined in said shank and extending from said bottom of said shank, said head being received in said first recess and said shank extending downwardly through said first hole of said base;

a coil spring received in said second recess of said base and having a first end formed in a center of said coil and a second end, said first end received in said second slit of said shank and said second end received in said first slit of said base;

a lower cap mounted to said bottom side of said base and supporting said coil spring, said lower cap having a second hole defined centrally therein and having a third recess defined in a bottom thereof receiving a connecting block therein which has a through hole defined longitudinally therein and a side hole defined radially from a periphery thereof, said side hole communicating with said through hole;

said rod having a first end and a second end, said first end thereof having a fourth hole defined radially therethrough, said first end of said rod being inserted into said side hole of said connecting block and a bolt extending through said through hole, said fourth hole and engaged with said threaded recess of said shank of said pinion, said second end thereof having a frame formed thereto so as to define an elongated space between the rod and the frame for receiving a stud extending from said fixing element therein;

said cylinder securely disposed to said front surface of said base and having a first end and a second end, said first end thereof having an end plug to close said first end and said second end thereof having a bottom, said end plug having a central hole defined therethrough and a piston rod being slidably received therein, said piston rod having a first end and a second end, said first end thereof having a rack inserted in said side slot of said base for an engagement with said pinion, said second end thereof having a piston disposed thereto, said piston having a first clearance defined between said piston rod and said piston and having a first flange and a second flange respectively extending radially from an outer periphery thereof and defining a first groove between said first and said second flanges, said first flange having an outer diameter smaller than an inner diameter of said cylinder such that a gap is defined between said first flange and said cylinder, said second flange having a plurality of sixth holes defined therein, a ring movably disposed between the first flange and the second flange and being able to be moved to contact against the first flange and the second flange depending upon a movement of said piston rod, a second clearance defined between an inner periphery of said ring and said piston rod, said gap being sealed by said ring when said piston is moved toward said bottom of said cylinder.

2. The door damping system as claimed in claim 1 wherein said base has a fifth hole defined laterally therein which located opposite to said side slot, said fifth hole communicating with said first recess and having a threaded section defined in an inner portion thereof so as to receive a ball and a spring in said fifth hole and a small bolt threadedly engaged with the threaded section, said head of said pinion having at least one fourth recess defined in an outer periphery thereof so as to receive said ball therein when said head of said pinion is rotated to a certain position.

3. The door damping system as claimed in claim 1 wherein said base has a fifth recess laterally defined therein and communicates with said side slot, said cylinder having a neck portion extending longitudinally therefrom so as to be inserted into said fifth recess.

* * * * *